US005609464A

United States Patent [19]

Moffitt et al.

[11] Patent Number: 5,609,464

[45] Date of Patent: Mar. 11, 1997

[54] LIFT BOOM ASSEMBLY FOR A LOADER MACHINE

[75] Inventors: John M. Moffitt, Wichita; Stephen A. Youngers, Clearwater, both of Kans.

[73] Assignee: Case Corporation, Racine, Wis.

[21] Appl. No.: 383,774

[22] Filed: Feb. 6, 1995

[51] Int. Cl.[6] ..... E02F 3/28

[52] U.S. Cl. ..... 414/685; 414/700

[58] Field of Search ..... 414/685, 686, 414/680, 697, 700

[56] References Cited

U.S. PATENT DOCUMENTS

| | | | |
|---|---|---|---|
| 1,863,696 | 6/1932 | North et al. . | |
| 2,310,284 | 2/1943 | Gurries . | |
| 2,345,620 | 4/1944 | Mork . | |
| 2,372,220 | 3/1945 | Mork . | |
| 2,849,132 | 8/1958 | Clarke . | |
| 2,980,271 | 4/1961 | Ulinski . | |
| 3,215,292 | 11/1965 | Halls . | |
| 3,352,441 | 11/1967 | Alden . | |
| 3,522,898 | 8/1970 | Rotheisler . | |
| 3,586,195 | 6/1971 | Beltrami . | |
| 4,122,960 | 10/1978 | Bauer et al. . | |
| 4,318,664 | 3/1982 | Gibert | 414/685 |
| 4,355,946 | 10/1982 | Wykhuis et al. | 414/707 |
| 4,427,334 | 1/1984 | Cople et al. | 414/710 |
| 4,636,133 | 1/1987 | Hess | 414/715 |
| 4,699,560 | 10/1987 | Ostermeyer et al. | 414/696 |
| 5,169,278 | 12/1992 | Hoechst et al. | 414/685 |

OTHER PUBLICATIONS

"No Mast on this Lift Truck . . . ", p. 77, *Mechanisms, Linkages, and Mechanical Controls,* by Nicholas P. Chironis (McGraw–Hill, 1965).

*Primary Examiner*—Donald W. Underwood
*Attorney, Agent, or Firm*—John W. Harbst

[57] ABSTRACT

A lift boom assembly including a pair of laterally spaced interconnected lift arms having a tool mounted between forward ends thereof. Each lift arm includes a main lift link having upper and lower connecting portions at a rear end thereof. A second lift link is pivotally connected to the upper connecting portion of the main lift link and partially controls movements of the respective lift arm. The opposite end of each second lift link is pivotally connected to a frame of a machine on which the lift assembly is mounted. Movement of the lift arms is further controlled by a pair of control arms. A lower end of each control arm is pivotally connected to the frame. When the boom assembly is in a lowered position relative to the frame, a second or upper end of each control arm extends upwardly and rearwardly from the lower end and is pivotally connected to the lower connecting portion of the respective main lift link. In response to vertical movements of the boom assembly between raised and lowered position, each control arm swings forwardly and rearwardly of its true vertical position to alter the movements of the lift arms and such that the tool is elevationally moved along a generally linear vertical path. A pair of extendable and retractable drivers provide powered vertical movements to the lift assembly and the tool carried thereby relative to the frame.

23 Claims, 3 Drawing Sheets

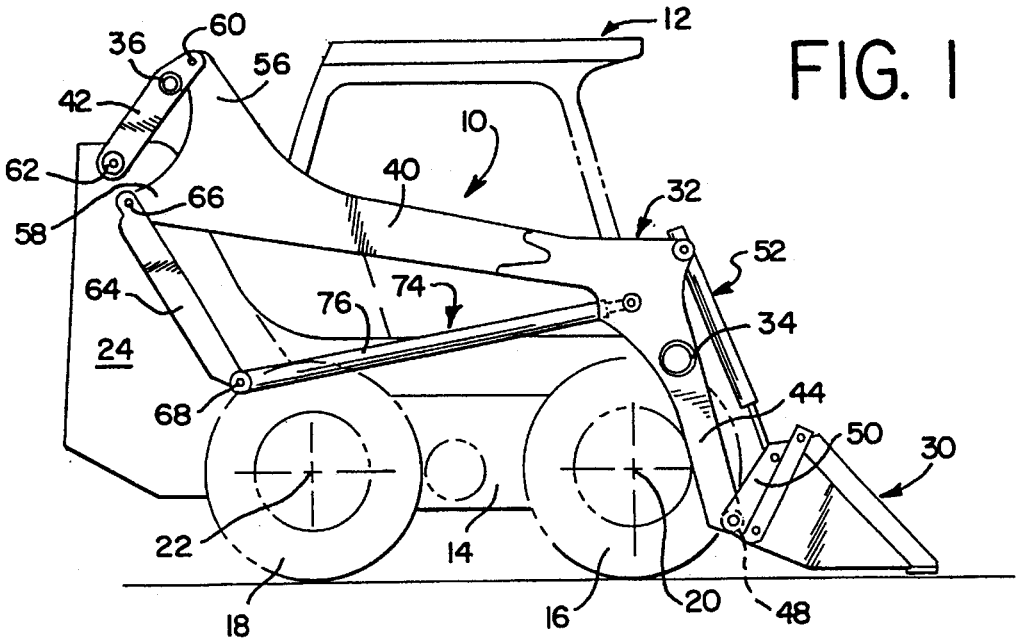
FIG. 1
FIG. 2
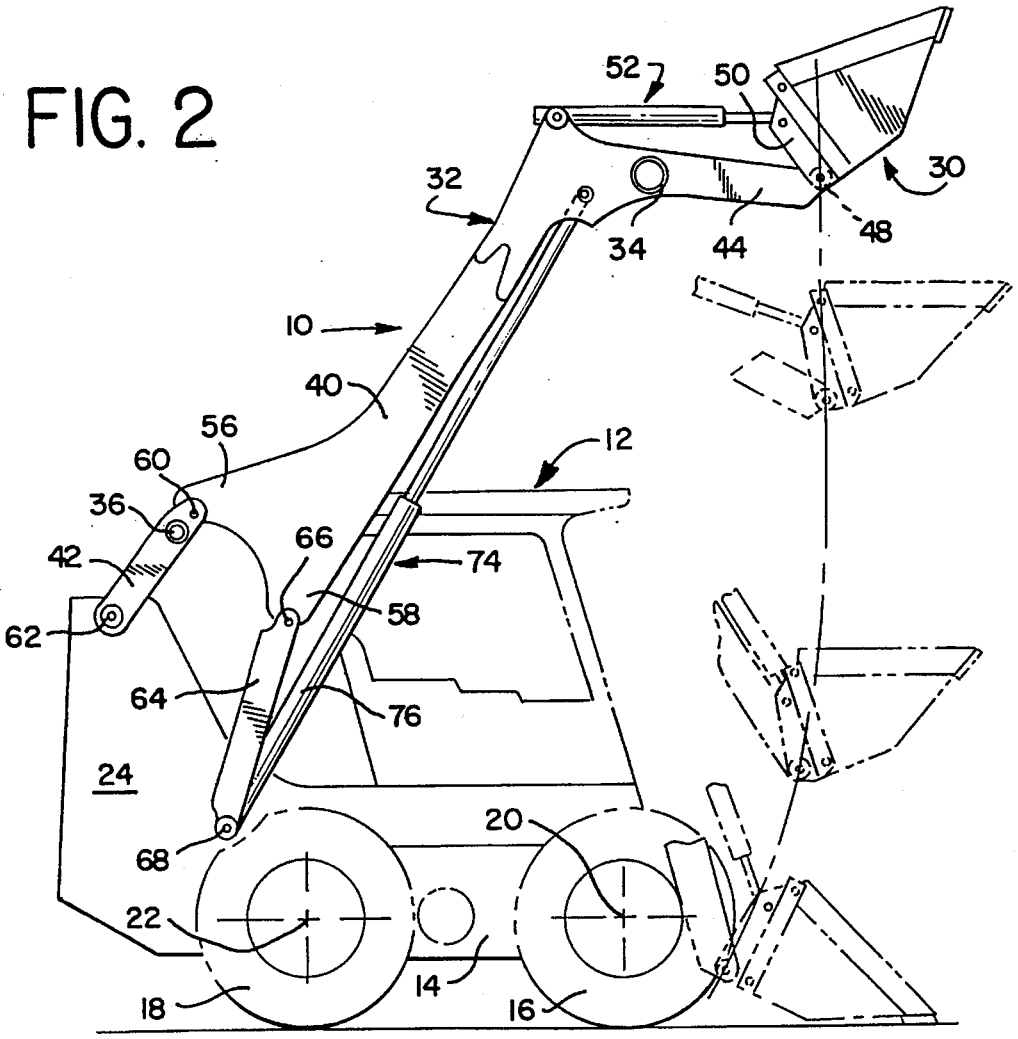

LIFT BOOM ASSEMBLY FOR A LOADER MACHINE

FIELD OF THE INVENTION

The present invention generally relates to machines having a lift boom assembly arranged in combination therewith and, more particularly, to a lift boom assembly that is configured to move a tool attached to a forward end of the boom assembly in a generally vertical linear path of travel between upper and lower positions thereof.

BACKGROUND OF THE INVENTION

Lift boom assemblies which mount a bucket or other tool to a machine, such as a front-end loader backhoe or skid steer loader, are well known in the art. The problems with such known devices, however, involves the path of vertical movement of the tool or bucket. That is, heretofore known lift boom assemblies tend to move the bucket or tool along a non-linear vertical path of travel in response to elevational movement of the boom assembly between lowered and raised positions. More specifically, as the boom assembly raises the bucket or tool to approximately midheight of its vertical travel, the bucket is moved both vertically and outwardly relative to a frame of the machine. As the boom assembly continues to raise, the bucket or tool is moved both elevationally and backwardly relative to the frame of the machine. The tendency to move the tool outwardly and backwardly relative to the frame of the machine impairs maneuvering of the bucket for dumping materials into a truck or the like and the overall stability or "tipping load" of the machine.

Thus, there is a need and a desire for a lift boom assembly that mounts a tool or bucket to a frame of a machine for elevational movement in a generally linear and vertical path of travel between its lower and raised position.

SUMMARY OF THE INVENTION

In view of the above, and in accordance with the present invention, there is provided a lift boom assembly for a machine having a fore-and-aft elongated mobile frame. The boom assembly of the present invention comprises a lift assembly including a pair of interconnected lift arms that are arranged on opposite sides of the frame. Each lift arm includes a main lift link that extends rearwardly from the front of the machine and a shorter or second link that is pivotally connected to a rear end of the main lift link. A tool is mounted to a forward end each main lift link. The movements of the lift arms are controlled such that the tool moves along a generally linear path of travel as the boom assembly elevationally moves between upper and lower positions relative to the frame of the machine.

The rear end of each main lift link has rigidly joined upper and lower connecting portions. The second or shorter lift link is articulately connected to the upper connecting portion of the main lift link and to the frame of the machine.

The path of movement of the lift arms is furthermore controlled by a pair of control arms. A lower end of each control arm is pivotally connected to the frame adjacent to the rear end of the frame. When the boom assembly is in a lowered position relative to the frame, a second or upper end of the control arm extends upwardly and rearwardly from the lower end of the control arm and is pivotally connected to the lower connecting portion of the main lift link.

A pivotal connection is defined between the second lift link and the upper connecting portion of a respective main lift link. Another or second pivotal connection is defined between the second lift link and the frame of the machine. A third pivotal connection is defined between the lower connecting portion of the main lift link and a respective control arm. To allow for swinging movements of the control arm, a fourth pivotal connection is established between the lower end of each control arm and the machine frame.

In a preferred form of the invention, when the boom assembly is in a lowered position relative to the frame, the first, second and third pivotal connections are all rearward of a vertical plane passing through the fourth pivotal connection. In those embodiments of the invention wherein the frame of the machine is supported for movement on front and rear wheels, all the above mentioned pivotal connections are disposed rearwardly of the axis of the rear pair of wheels supporting the mobile frame of the machine when the boom is in a lowered position relative to the frame of the machine.

A pair of extendable and retractable drivers, arranged on opposite sides of the frame, provide powered vertical movements to the lift assembly and the tool carried thereby relative to the frame. Preferably, a linearly distendable hydraulically operated cylinder is operably connected toward a forward end of each lift arm on opposite sides of the machine frame. The other end of each driver is articulately connected toward a rear end of the machine frame. In one embodiment of the invention, each driver is articulately connected to the loader frame at substantially the same location as the control arm. In an alternative embodiment, each driver is articulately connected intermediate the ends of the respective control arm.

As the boom assembly is raised by operating the drivers, the second lift link of each lift arm, partially controls movement of the respective lift arm by limiting movement of the pivotal connection defined between the second link and the upper connecting portion of the respective main lift link. Moreover, in response to vertical movements of the boom assembly between raised and lowered positions, the control arm connected to the lower connecting portion of each main lift link swings forwardly and rearwardly of its true vertical position to control movements of the lift arm. The angular swinging movements of the control arms are asymmetrical relative to a vertical plane passing through the pivotal connection of the control arm to the frame. The asymmetrical movements of the control arm relative to the lower pivotal connection of the control arm alters the effective length of the boom assembly lift arms such that the tool articulately connected to the lift arms is elevationally moved along a generally linear path throughout at least the upper one-half of the range of movement of the boom assembly.

In a most preferred form of the invention, the drivers, control arm, and the lift links comprising each lift arm are arranged in a substantially common plane. As such, the lateral dimension of the loader can be minimalized. Mounting both the control arms and the lift cylinders rearwardly of the rear axis about which the rear wheels turn offers distinct and surprising advantages. First, by mounting both the control arms and the lower ends of the lift cylinders at the rear of the machine, the compressive force applied to the control arms decreases or becomes a tension force as the stroke of the hydraulic cylinder reaches its maximum movement. Moreover, mounting the lift cylinder toward the rear of the machine allows a cylinder having an extended stroke length to be used in combination with the lift arms. As will be appreciated by those skilled in the art, utilizing a driver having an extended stroke length to effect lifting of the boom assembly lowers the cylinder force required to lift the boom assembly.

Numerous other features and advantages of the present invention will become readily apparent from the following detailed description, the accompanying drawings, and the appended claims.

BRIEF DESCRIPTION OF THE DRAWINGS

FIG. 1 is a schematic side elevational view of a machine with a lift boom assembly according to the present invention mounted thereon;

FIG. 2 is a schematic side elevational view similar to FIG. 1 but having the lift boom assembly arranged in an elevated position;

DESCRIPTION OF THE PRESENT INVENTION

Figure 3:
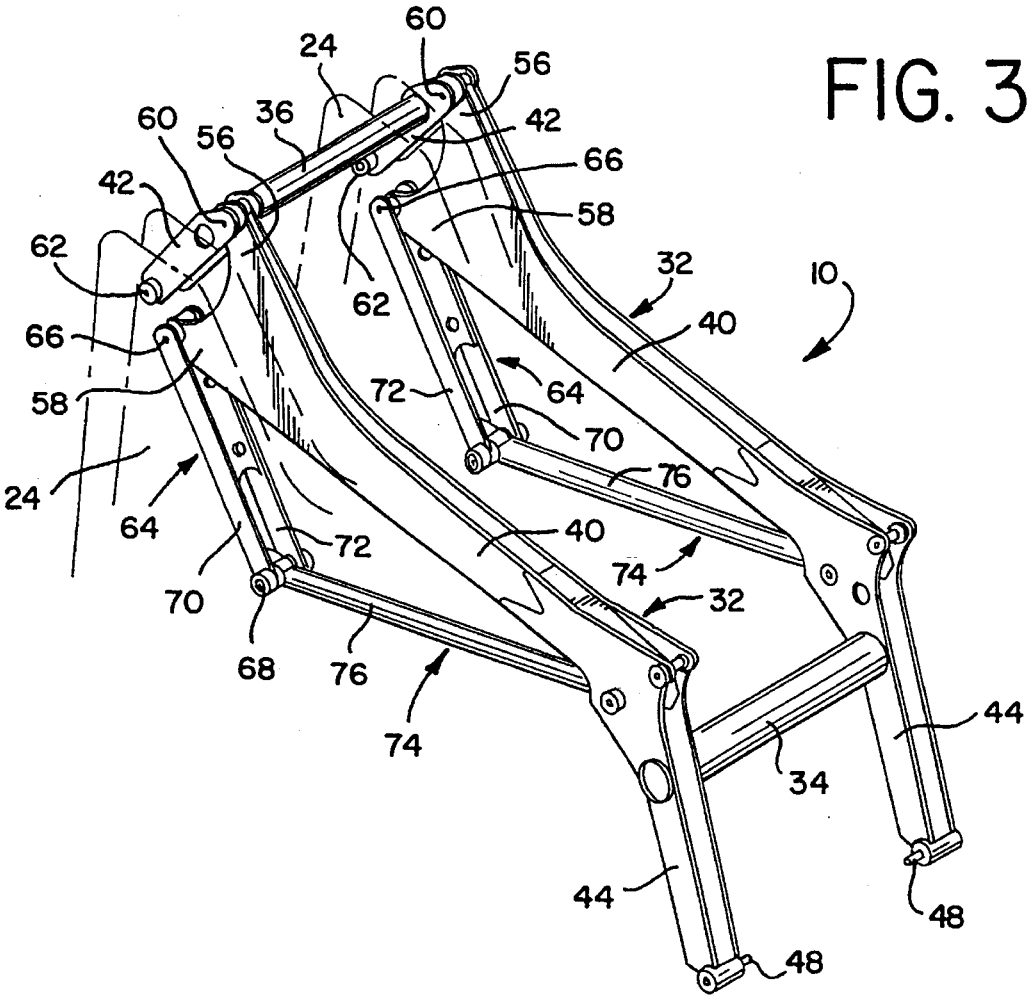
FIG. 3 is a schematic perspective view of the loader boom assembly shown in FIG. 1 mounted on a simplified illustration of a machine.

While the present invention is susceptible of embodiment in various forms, there are shown in the drawing presently preferred embodiments of the invention hereinafter described with the understanding that present disclosure is to be considered as setting for exemplification of the invention and is not intended to limited invention to the specific embodiments illustrated.

Referring now to the drawings, wherein like reference numerals refer to like parts throughout the several views, a lift boom assembly 10 is shown mounted on a self-propelled machine 12. In the illustrated embodiment, the lift boom assembly 10 is shown as being mounted on a skid steer loader having a fore-and-aft elongated frame 14 that is supported on front and rear pairs of wheels 16 and 18, respectively. The wheels 16, 18 project to opposite lateral sides of the frame 14. The front pair of wheels 16 each turn about an axis 20 while the rear pair of wheels 18 turn about an axis 22. As is conventional with skid steer loaders, boom supports 24 project upwardly from a rear portion of the frame 14. As shown in FIG. 3, each boom support 24 comprises a pair of laterally spaced apart plates.

It should be recognized, however, that the lift boom assembly 10 of the present invention is equally applicable to other machines, such as front-end loaders or loader backhoes. Although front-end loaders and loader backhoes are not necessarily equipped with upstruck boom supports of the type illustrated, the illustrated vertical upstruck boom support design is not required to practice the invention and the scope of the present invention should not be limited thereto. Suffice it to say, all that is required is appropriate frame structure for pivotally attaching the boom assembly as described below in detail thereto.

The lift boom assembly 10 of the present invention is mounted to the machine frame 14 to elevationally position a working tool 30, such as a bucket, between lowered and raised positions. As shown, the tool or bucket 30 is articulately connected toward a front end of the boom assembly 10.

The lift boom assembly 10 includes a pair of elongated lift arms 32 arranged on opposite sides of the frame 14 and which are operably coupled to elevationally move in unison relative to each other. To add strength and rigidity to the boom assembly 10, the laterally spaced lift arms 32 are connected to each other toward their forward ends by a suitably shaped cross member 34. To add further strength and rigidity to the boom assembly 10, the laterally spaced lift arms 32 are connected to each other toward their rear ends by a suitably shaped cross member 36.

The lift arms 32 arranged on opposite sides of the frame are substantially identical in structure and, thus, only one lift arm will be described in detail with the understanding that the other lift arm is substantially similar thereto. Preferably, each lift arm 32 is of multi-piece construction. That is, each lift arm 32 includes a main lift link 40 and a second lift link 42 that are articulately connected to each other toward the rear of the machine. In the illustrated embodiment of the invention, the second lift link 42 is considerably shorter in length than the main lift link 40.

As shown, each main lift link 40 has a dog-legged configuration between forward and rear ends thereof. The forward end of each main lift link 40 is provided with a downwardly extending arm 44. In the illustrated embodiment, each downwardly extending arm 44 extends just ahead of the front wheels 16 of the machine 10 when the boom assembly 10 is in a lower position as shown in FIG. 1. Each downwardly extending arm 44 has an attachment pin 48 that defines a pivot axis for the tool/bucket 30 mounted thereon.

A conventional subframe 50 is pivotally mounted on the pins 48 and supports the tool 30 in a well known manner. A tilt or tip cylinder or driver, generally represented by reference numeral 52, controls the angular disposition of the tool/bucket 30 relative to the pivot pin 48 and thereby, relative to the boom assembly. As is conventional, the base end of driver 52 is articulately connected to the lift link 40 while the rod end of the driver 52 is articulately connected in a well known manner to the subframe 50. In the most preferred form of the invention, the driver 52 comprises a double acting hydraulically actuated cylinder.

As shown, the rear end of each main lift link 40 is configured with upper and lower connecting portions 56 and 58, respectively, that are rigidly joined to each other and are arranged in generally planar configuration relative to each other. The upper connecting portion 56 of each main lift link 40 is pivotally connected, as with a suitable pivot pin 60 defining a pivot axis, to a respective second lift link 42. When so connected, the main lift link 40 and second lift link 42 are movingly disposed in substantially the same plane along the side of the machine frame 14.

The second or lower end of each second lift link 42 is articulately connected, as by a suitable pivot pin 62 defining a pivot axis, to the respective support 24 adjacent the rear of the machine 10. In the preferred form of the invention, the pin 62 pivotally connects the lift link 42 to an upper end of the respective support 24 preferably between the plates comprising the support 24. In a most preferred form of the invention, the axis of each pivot pin 62 is elevated a substantial distance above the surface that supports the machine frame 14.

The lower connecting portion 58 of each main lift link 40 is articulately connected to a upper end of a rigid fixed length control arm 64 as by a pivot pin 66. A lower end of each control arm 64 is articulately or pivotally connected as by pivot pin 68 adjacent the rear end of the machine frame 14. In the illustrated form of the invention, the lower end of each control arm 64 is pivotally connected to the machine frame 14 rearwardly of the axis 22 about which the rear wheels 18 turn.

When the boom assembly 10 is in a lower position, as shown in FIGS. 1 and 3, each control arm 64 extends from its pivotal connection 68 to the frame 14 upwardly and rearwardly to the lower connecting portion 58 of the respective main lift link 40. As shown in FIG. 1, in a preferred form of the invention, and when the boom assembly is in a lowered position relative to the frame 14, the pivotal connection 60 between the upper connecting portion 56 of the main lift link 40 and the second lift link 42, the pivotal connection 62 between the second lift link 42 of each lift arm 32 and the frame 14, and the pivotal connection 66 of the lower connecting portion 58 of each main lift link 40 to the respective control arm 64 are all disposed rearwardly of a vertical plane passing though the pivot connection 68 connecting the lower end of each control arm 64 to the machine frame 14 of machine 10.

As shown in FIG. 3, each control arm 64 includes a rigid structure preferably comprised of two laterally spaced plates 70 and 72. At their upper ends, plates 70, 72 embrace the lower connecting portion 58 of the main lift link 40 therebetween.

The elevation of the boom assembly 10 is controlled by powered drivers 74 arranged on opposite lateral sides of the frame 14. In the illustrated embodiment, each driver 74 includes a double acting hydraulic cylinder 76. As will be appreciated, the operable linearly distended length of the cylinder 76 controls the elevation of the boom assembly 10. The operable linearly distended length of cylinder 76 is that effective length measured between the locations wherein the cylinder 76 applies a reaction force that operably affects the vertical disposition of the boom assembly 10. As shown, the rod end of each cylinder 76 is articulately connected to the respective main lift link 40 intermediate the front and rear ends thereof and preferably toward a front end of the respective main lift link 40. The cylinder end of each cylinder 76 is connected toward a rear of the machine 12 at a location lower than the rod end of the respective cylinder. It will be understood, however, without detracting or departing from the spirit and scope of the present invention, that each cylinder 76 could be turned end-for-end thus exchanging the respective connecting points for the rod and cylinder ends.

In the embodiment illustrated in FIGS. 1 and 2, albeit not required, the lower or cylinder end of each driver 74 is connected to the frame 14 rearwardly of the axis 22 about which the rear wheels 18 turn. In the most preferred form of the invention, the cylinder end of each driver 74 is connected to at a common location with the lower end of the respective control arm 64 as by pivot pin 68.

Figure 4:
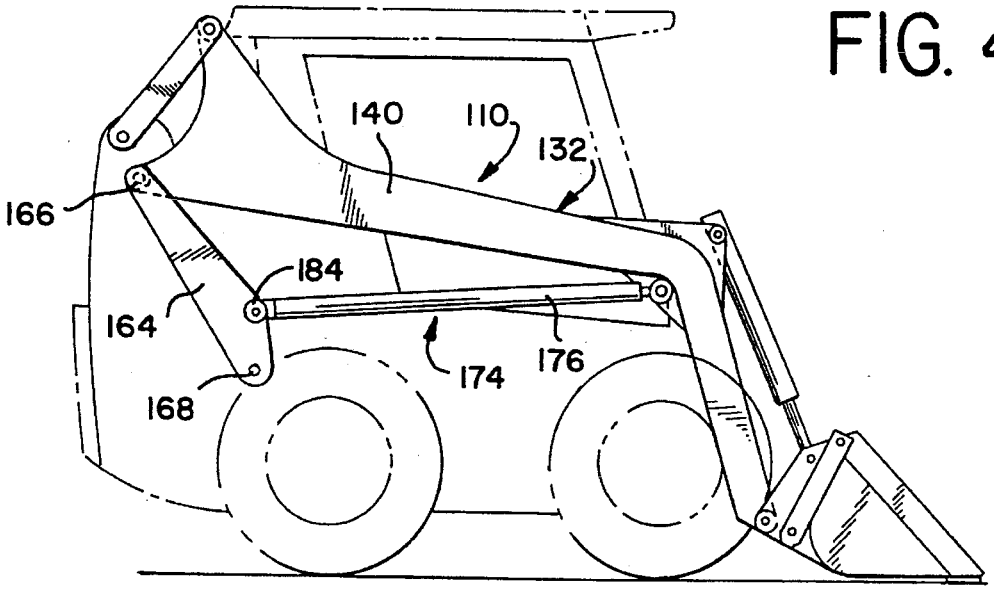
FIGS. 4 through 6 are schematic side elevational views of a second embodiment of a boom assembly mounted on a machine with the boom assembly illustrated in various degrees of elevation.
Figure 5:
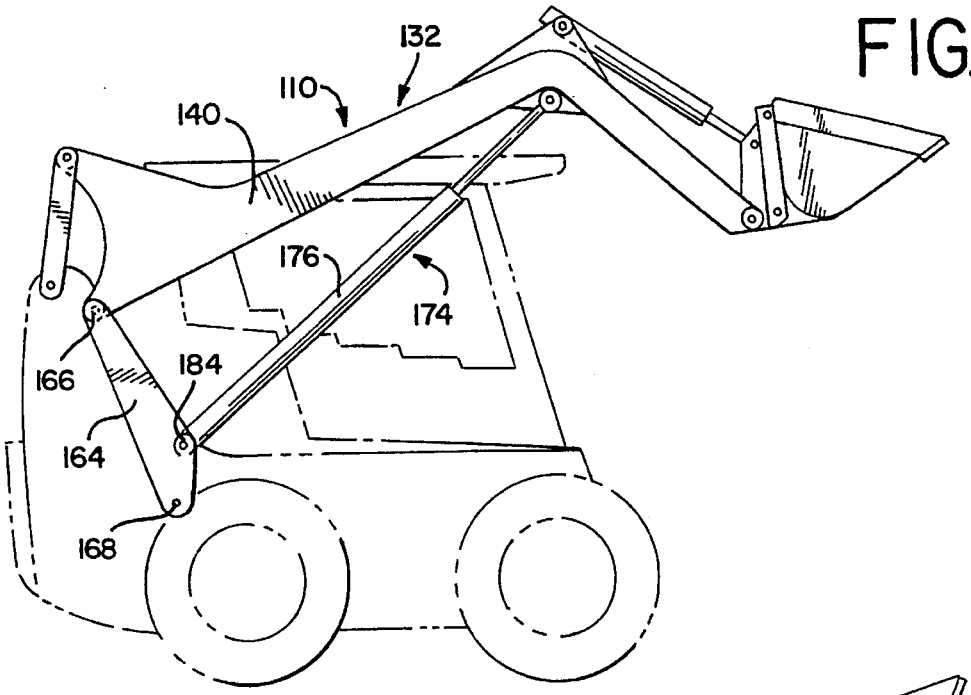
Figure 6:
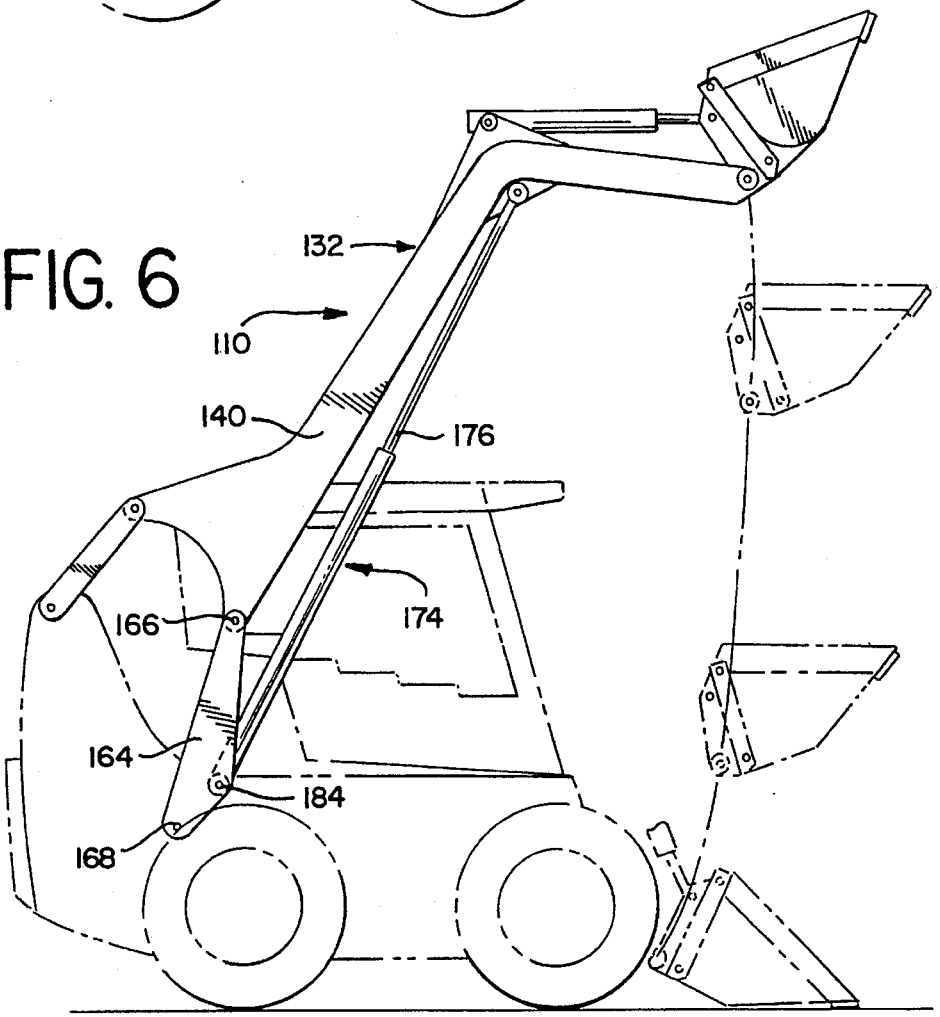

Another embodiment of the invention is illustrated in FIGS. 4 through 6 and is designated generally by reference number 110. The boom assembly 110 is similar, and functions in a similar manner, to the boom assembly 10 illustrated in FIGS. 1 through 3. The elements of the alternative embodiment of the boom assembly 110 that are identical or functionally analogous to those elements comprising boom assembly 10 are designated by reference numerals identical of those used for the first embodiment with the exception that the second embodiment reference numerals are in the one-hundred series.

In this alternative form of the invention, each driver 174 is in the form of a cylinder 176 having one end articulately connected to a main lift link 140 of a lift arm 132. The other end of the cylinder 176 is articulately connected to the respective control arm 164 intermediate the ends thereof preferably by a pivot pin 184. Thus, as the boom assembly 110 begins to raise from the position shown in FIG. 4, the control link 164 with the driver 174 connected thereto moves forwardly thus adding to the stroke of the cylinder 176. As shown in FIG. 6, when the boom assembly 110 reaches its top end or uppermost position, the longitudinal axis of cylinder 176 is in generally the same position as is the longitudinal axis of cylinder 76 when boom assembly 10 is in a similar position.

Operation of the boom assembly 10 will now be described. The operative length of driver 74 and, thus, the elevational position of boom assembly 10 is preferably controlled through a readily accessible valve (not shown) provided at an operator's station and which connects the cylinders 76 to a suitable source of hydraulic pressure (not shown) conventionally located on the frame 14 of the machine 12. As the boom assembly 10 is raised, the path of travel of the tool/bucket 30 will define a substantially linear vertical path of travel throughout the upper part of the working range used for dumping of the bucket.

The tilt or tip cylinder or driver 52 can be operated as desired for tilting the subframe 50 and the bucket 30 about the axis of the attachment pins 48 in the usual manner.

The second lift link 42 connected to the upper connecting portion 56 of each lift link 40 and the control arm 64 connected to the lower connecting portion 58 of each lift link 40 combine to control the elevational movements of the main lift links 40 as each cylinder 76 is extended and retracted. When the boom assembly 10 is initially raised from its lowermost position shown in FIG. 1, the pivot pin 60, interconnecting upper connecting portion 56 of the main lift link 40 and the second lift link 42, rearwardly swings about an arc centered about pin 62 while the pivot pin 66, interconnecting the lower connecting portion 58 of the main lift link 40 and the respective control arm 64, swings about an arc centered about pivot pin 68. As such, movement of the front end of the lift arms 32 is modified from a purely accurate path of movement. After the boom assembly 10 is raised approximately through one-half of its vertical path of travel between its lower and upper positions, the rearward movement of the pivot pin 60 ceases and pivot pin 60 begins to move forwardly about the arc centered about pin 62. Thus, the upper one-half of the elevational movement of the front end of the lift arms 32 is further modified from a purely arcuate path of travel to cause the vertical path of movement of the tool/bucket 30 to move in a generally linear path.

As should be appreciated from a complete understanding of the present invention, in response to vertical movement of the boom assembly 10 between lowered and raised positions the control arms 64 swing forwardly and rearwardly of their true vertical position to facilitate control over the movements of the lift arms 32. In the preferred form of the invention, the fore-and-aft swinging movements of the control arms 64 are asymmetrical relative to a vertical plane passing through the pivot connection 68. That is, the configuration of the boom assembly is such that the control arms 64 angularly move more forwardly of the pivot connection 68 as the lift arms 32 are raised through their upper extent of movement and then rearwardly thereof as the lift arms 32 move through their lower extent of movement so as to alter the effective length of the boom assembly lift arms 32 thereby moving the tool 30 along a substantially linear vertical path of movement after the lift arms 32 are elevated a predetermined distance above the support surface for the machine frame 14.

In the second embodiment of the invention, the cylinder end of each driver 174 is connected to the control link or arm 164 intermediate the ends thereof. While slightly reducing the hydraulic lift breakout force, this embodiment of the linkage arrangement reduces the cylinder stroke and thereby reduces the cycle time required to move the bucket between lower and upper positions in the range of 15% to 20%. As will be appreciated, mounting the driver 174 for combined movement with the respective control arm 164 furthermore adds to the effective stroke of the cylinder 176 thereby maximizing the lifting height of the boom assembly.

In addition to reducing the stroke of the cylinder 176 and thus, enhancing the performance of the lift assembly, by proper selection of the link geometry, the alternative embodiment of the boom assembly shown in FIG. 4–6 can also provide a cushioning effect on the cylinder and lift assembly. That is, when the cylinder end of the cylinder 176 is connected to the control link 164 at a location substantially forward of the plane established between the axis of the pivot pins 166 and 168, and as the boom assembly 110 raises, the end of each cylinder 176 will go "over center" and start moving away from the opposite end of the cylinder 176 connected to the main lift link 140. This effectively reduces the vertical velocity of the main lift link 140.

In either embodiment, the boom assembly provides a vertical lift path which is generally linear throughout at least the upper one-half of the range of movement of the loader boom so as to facilitate operation of the loader and filling trucks. The ability of the boom assembly to move the tool or bucket along a generally linear path of movement increases the effective holding capacity of the bucket thereby increasing efficiency of the machine. All of the components of the lift boom assembly including the lift arms, control links and power drivers are arranged in a substantially common plane thus minimalizing the lateral dimension added to the width of the existing frame of the machine. Moreover, the boom assembly of the present invention provides a positive and reliable control for obtaining a vertical path of movement for the bucket/tool secured to the forward ends of the lift arms.

From the foregoing, it will be observed that numerous modifications and variations can be effected without departing from the true spirit and scope of the novel concept of the present invention. It will be appreciated that the present disclosure is intended to set forth exemplification of the invention, and is not intended to limit the invention to the specific embodiments illustrated. The disclosure is intended to cover by the appended claims all such modifications as fall within the scope of the claims.

What is claimed is:

1. A lift boom assembly mounted on a machine having a fore-and-aft extending frame, comprising:

a pair of generally vertical supports for supporting the boom assembly, said supports being disposed toward a rear of the frame;

a lift assembly having a pair of lift arms arranged on opposite lateral sides of the frame, each lift arm having a forward end to which a working tool is mounted and comprises a main lift link and a second lift link pivotally connected to each other, said main lift link extending rearwardly from a forward portion of the frame and including at a rear end thereof upper and lower connecting portions, said second lift link being substantially shorter in length than said main lift link and has a first end pivotally connected to the upper connecting portion of the main lift link and a second end pivotally connected to one of said supports;

a pair of extendable and retractable drivers arranged on opposite sides of the frame and connected between the frame and a respective lift arm for effecting powered vertical movements of the lift assembly and the tool carried thereby relative to the frame; and a pair of control arms, each control arm having a first end pivotally connected to the frame adjacent the rear end thereof beneath the location whereat the second lift link is connected to the frame and having a second end which, when the boom assembly is in a lowered position, extends upwardly and rearwardly from the first end and is pivotally connected to said lower connecting portion of a respective main lift link.

2. The invention according to claim 1 wherein the second lift link of each lift arm is pivotally connected to an upper end of the supports substantially above a support surface of the machine frame.

3. The invention assembly according to claim 1 wherein a first end of each driver is articulately connected to a rear end of the machine frame while a second end of the driver is articulately connected to a front end of a respective main lift link.

4. A lift boom assembly mounted on a machine having a fore-and-aft extending frame, comprising:

a pair of supports for supporting the boom assembly, said supports being disposed toward a rear of the frame;

a lift assembly having a pair of lift arms arranged on opposite lateral sides of the frame, each lift arm having a forward end to which a working tool is mounted and comprises a main lift link and a second lift link pivotally connected to each other, said main lift link extending rearwardly from a forward portion of the frame and including at a rear end thereof upper and lower connecting portions, said second lift link having a first end pivotally connected to the upper connecting portion of the main lift link and a second end pivotally connected to one of said supports;

a pair of extendable and retractable drivers arranged on opposite sides of the frame and connected between the frame and a respective lift arm for effecting powered vertical movements of the lift assembly and the tool carried thereby relative to the frame; and a pair of control arms, each control arm having a first end pivotally connected to the frame adjacent the rear end thereof and having a second end which, when the boom assembly is in a lowered position, extends upwardly and rearwardly from the first end and is pivotally connected to said lower connecting portion of a respective main lift link, and wherein the first end of each driver and the first end of each control are connected to the frame at a common location.

5. The invention according to claim 1 wherein a first end of each driver is pivotally connected to a respective control arm intermediate the ends thereof.

6. The invention according to claim 1 wherein the main and second links, the powered driver, and the control arms on each side of the frame all lie in a common vertical plane relative to each other.

7. The invention according to claim 4 wherein the upper and lower connecting portions of the main lift links lie in substantially the same vertical plane as a respective control arm so as to minimalize the width of the machine.

8. A lift boom assembly for vertically moving a working tool carried by said boom assembly between lowered and raised positions along a substantially vertical path, said boom assembly being mounted to a machine having a fore-and-aft extending mobile frame, said lift boom assembly comprising:

a pair of supports for supporting the boom assembly, said supports being disposed toward a rear of the frame and on each side thereof, and wherein each support extends upwardly from and terminates at an upper end located substantially above a support surface for said frame;

a lift assembly having a pair of lift arms arranged on opposite sides of the frame, each of said lift arms having a forward end to which said working tool is mounted and comprising a main lift link and a second lift link pivotally connected to each other, said main lift link extending rearwardly from a forward portion of the frame and including at a rear end thereof upper and lower connecting portions, said second lift link having a first end pivotally connected to the upper connecting portion of the main lift link and a second end pivotally connected to the upper end of one of said supports;

a pair of extendable and retractable drivers arranged on opposite lateral sides of the frame and connected between the frame and a respective lift am for effecting powered vertical movements of the lift assembly relative to the frame; and a pair of control arms, each control arm having a first end pivotally connected to the rear end of the frame and having a second end disposed above said first end and that is pivotally connected to the lower connecting portion of a respective main lift link such that the control link swings forwardly and rearwardly of its true vertical position to control movements of the lift assembly in response to vertical movement of the boom assembly between raised and lowered positions.

9. The invention according to claim 8 wherein, when the boom assembly is in a lowered position relative to the frame, the pivotal connection defined between the upper connecting portion of the main lift link and said second lift link is disposed above the pivotal connection of the second lift link and the frame, and the pivotal connection defined between the lower connecting portion of the main lift link and the respective control arm is adjacent to and below the pivotal connection of the second lift link and the frame.

10. The invention according to claim 8 wherein the pivotal connection between the second lift link and the main lift link of each lift arm moves along a controlled arcuate path of travel as the lift assembly is raised by the powered drivers, and wherein said second lift link of each lift arm is shorter than the respective main lift link and control arm such that as said lift assembly raises the pivotal connection between the second lift link and the main lift link of a respective lift arm moves asymmetrically relative to a vertical plane passing through the pivotal connection of the control arm to the frame to alter the effective length of the boom assembly lift arms thereby moving the tool along a substantially linear vertical path of movement after the lift arms are elevated a predetermined distance above the support surface for the machine frame.

11. The invention according to claim 8 wherein the pivotal connections defined between the second lift link of each lift arm and the frame, the second lift link of each lift arm and the upper connecting portion of the main lift link, and the lower connecting portion of each main lift arm and the respective control arm, are all disposed to one side of a vertical plane passing through the pivotal connection defined between the control arm and the frame when the boom assembly is in a lowered position relative to the frame.

12. The invention according to claim 8 wherein the first end of each control arm and one end of each driver are connected to the frame at a common location.

13. The invention according to claim 8 wherein a first end of each driver is articulately connected to the control arm intermediate the ends of the control arm.

14. The invention according to claim 8 wherein the lift links comprising each lift arm, the respective driver, and the respective control arm lie in a common vertical plane relative to each other.

15. The invention according to claim 8 wherein said main lift link is substantially longer than said second lift link.

16. A lift boom assembly mounted on a machine having a fore-and-aft extending frame supported for movement by a front pair of wheels mounted on a front axle and a rear pair of wheels mounted on a rear axle, said lift boom assembly comprising:

a pair of supports for supporting the boom assembly, said supports being disposed toward a rear of the frame;

a lift assembly having a pair of lift arms arranged on opposite lateral sides of the frame, each of said lift arms having a forward end to which a working tool is mounted and comprises, in combination, a main lift link and a second lift link, said main lift link extending rearwardly from a forward portion of the frame and including at a rear end thereof first and second connecting portions, said second lift link having a first end connected at a first pivotal connection to the first connecting portion of a respective main lift link and a lower second end connected at a second pivot connection to one of said supports;

a pair of extendable and retractable drivers arranged on opposite sides of the frame and connected between the frame and a respective lift arm for effecting powered vertical movements of the lift assembly and tool relative to the frame; and a pair of control arms, each control arm having a first end connected at a third pivot connection to the second connecting portion of a respective main lift link and a lower second end connected at a fourth pivotal connection to the frame of the machine, and wherein the first, second, third and fourth pivotal connections defined by each lift arm and control arm combination are all rearward of the rear axle of the machine.

17. The invention according to claim 16 wherein the pivotal connection between the second lift link and the main lift link of each lift arm moves along a controlled arcuate path of travel as the lift assembly is raised by the powered drivers, and wherein said second lift link of each lift arm is shorter than the respective main lift link and control arm such that as said lift assembly raises the pivotal connection between the second lift link and the main lift link of a respective lift arm moves asymmetrically as the control arm swings about its lower pivotal connection to the frame such that each lift arm of the boom assembly is effectively extended and retracted in response to vertical movements of the boom assembly thereby moving the tool along a substantially linear vertical path of movement as the boom assembly moves between raised and lowered positions relative to the frame.

18. The invention according to claim 16 wherein when the boom assembly is in a lowered position relative to the frame, the first pivotal connection is disposed above the second pivotal connection and the third pivotal connection is adjacent to and below the second pivotal connection, and wherein the first, second and third pivotal connections are all rearward of a vertical plane passing through the fourth pivotal connection.

19. The invention according to claim 16 wherein the second pivotal connection connects the second lift link of each lift arm to an upper end of a respective support substantially above a support surface for the machine.

20. The invention according to claim 16 wherein a first end of each driver is articulately connected to a rear end of the machine frame while a second end of the driver is articulately connected to a front end of a respective main lift link.

21. The invention according to claim 20 wherein the first end of each driver is connected to a respective control arm intermediate the ends thereof.

22. The invention according to claim 20 wherein the first end of each driver and the second end of the each control arm are connected to the frame at a common location.

23. A lift boom assembly mounted on a self-propelled skid steer loader having a fore-and-aft extending frame that is supported by a pair of front and a pair of rear wheels, each pair of wheels being rotatable about a fixed laterally extending axis, said frame having boom supports attached to a rear thereof, a lift assembly comprising a pair of lift arms arranged on opposite sides of the frame and which are operably coupled to each other, each lift arm having a forward end to which a working tool is articulately mounted and a rear end, said pair of lift arms each comprising an elongated main lift link and a shorter second lift link that are pivotally interconnected to each other, each main lift link extending rearwardly from a forward portion of the frame and includes, at a rear end thereof, upper and lower rigidly joined connecting portions, said second lift link having a first end pivotally connected to the upper connecting portion of the main lift link and a second end pivotally connected to an upper end of the respective boom support at a location substantially above a support surface of the frame rearwardly of and vertically between the upper and lower connecting portions of the respective main lift link when the boom assembly is in a lowered position relative to the frame, a pair of extendable/retractable drivers arranged on opposite sides of and interconnected between the frame and said lift arms for effecting powered elevational movements of the boom assembly relative to the frame, and a pair of control arms, each control arm having a first end pivotally connected to the frame rearwardly of the rear wheel axis and having a second end which, when the boom assembly is in a lowered position, extends upwardly and rearwardly from the first end and is pivotally connected to the lower connecting portion of a respective main lift link, and whereby the pivotal connection between the control arm and the main lift link of each lift arm moves along an arc as the lift arm assembly is raised by the powered drivers and the pivot between each main lift link and second link moves in a controlled path that effectively extends and retracts the effective length of the main lift arm links of each lift arm such that the tool carried at the forward end of the boom assembly moves along a substantially vertical path between lowered and raised positions thereof.

* * * * *